US005520378A

United States Patent [19]

Kepert et al.

[11] Patent Number: 5,520,378

[45] Date of Patent: May 28, 1996

[54] FOLDING APPARATUS FOR ROTARY PRINTING PRESSES

[75] Inventors: Manfred Kepert, Grosskarlbach; Rudolf Stäb, Frankenthal, both of Germany

[73] Assignee: Albert Frankenthal Aktiengesellschaft, Frankenthal, Germany

[21] Appl. No.: 234,963

[22] Filed: Apr. 28, 1994

[30] Foreign Application Priority Data

Apr. 28, 1993 [DE] Germany ..... 43 13 938.8

[51] Int. Cl.[6] ..... B41F 13/58; B41F 1/08

[52] U.S. Cl. ..... 270/8; 493/429; 493/432; 270/45

[58] Field of Search ..... 270/4, 5, 8, 20.1, 270/21.1, 42, 49, 50; 493/424, 425, 426, 427, 428, 429, 431, 432

[56] References Cited

U.S. PATENT DOCUMENTS

| | | | |
|---|---|---|---|
| 1,170,136 | 1/1916 | Barber | 270/47 |
| 1,193,449 | 6/1915 | Barber | 270/47 |
| 2,487,404 | 11/1949 | Zuckerman | 270/43 |
| 2,528,159 | 10/1950 | Meyer | 270/50 |
| 2,891,791 | 6/1959 | Chase | 493/432 |
| 2,991,995 | 7/1961 | Zuckerman | 270/50 |
| 4,147,337 | 4/1979 | Bolza-Shunemann | 270/21.1 X |
| 4,159,823 | 7/1979 | Bryer et al. | 270/21.1 |
| 4,648,586 | 3/1987 | Michalik | 270/50 |
| 4,946,151 | 8/1990 | Liebert | 270/21.1 X |
| 5,242,367 | 9/1993 | Marmin | 493/424 X |
| 5,259,604 | 11/1993 | Schneider et al. | 270/6 X |
| 5,287,805 | 2/1994 | Fischer et al. | 270/47 X |
| 5,386,979 | 2/1995 | Muller | 270/21.1 X |

FOREIGN PATENT DOCUMENTS

| | | |
|---|---|---|
| 0233377 | 8/1987 | European Pat. Off. . |
| 2620972 | 3/1989 | France . |
| 1905632 | 8/1970 | Germany . |

*Primary Examiner*—John E. Ryznic
*Attorney, Agent, or Firm*—Jones, Tullar & Cooper

[57] ABSTRACT

A folding apparatus for rotary printing presses uses at least a single stage speed reducing device between a collection cylinder and a folding blade cylinder to reduce the speed of travel of signatures before they are cross-folded. The reduction in the speed of travel of the signatures eliminates damage to the signatures during their cross folding while allowing the printing press to operate at a high rate of speed.

7 Claims, 2 Drawing Sheets

FOLDING APPARATUS FOR ROTARY PRINTING PRESSES

FIELD OF THE INVENTION

The present invention is directed generally to folding apparatus for a rotary printing press. More particularly, the present invention is directed to a folding apparatus for a web fed rotary printing press. Most specifically, the present invention is directed to a folding apparatus for a web fed rotary printing press in which the speed of the product travel is controlled to prevent product damage. The folding apparatus receives a web that is coming from a web feeding device, and cross-cuts the web into signatures. These signatures are picked up by a collecting cylinder and are fed to folding knife cylinders and cooperating folding jaw cylinders by use of transfer cylinders. The signatures are folded in the folding jaw cylinders to create folded products which are delivered to a delivery device. The speed of operation of the transfer cylinders and of the folding blade and jaw cylinders are controlled to prevent damage to the folded products.

DESCRIPTION OF THE PRIOR ART

Folding apparatuses for use with rotary printing presses are generally known in the art. One such folding apparatus is set forth in U.S. Pat. No. 4,159,823 which shows an apparatus that initially cross-cuts the products and forms a first cross fold in the cross-cut products. Once the first cross fold has been formed, the products are split into two delivery batches. The conveying speed of the products can be set by control of the speeds of the gripper and transfer cylinders which are positioned between the folding jaw cylinder and the delivery conveyor. This speed control is accomplished by use of appropriate gear drives so that the speed of travel of the products is reduced as the products approach the delivery.

One limitation of this prior art folding device lies in the creation of a so-called "whip effect" in the products to be folded by the folding jaw cylinder. This "whip effect" increases with increased production speeds. As the product is to be folded at the folding jaw cylinder, the ends of the product held by the gripper or the point spur on the folding blade cylinder undergo a reversal of their direction of travel after the formation of the first cross-fold. As production speeds increase and as the weight of the products being folded increases, it becomes necessary to slow down the large mass forces and to accelerate them again in the opposite direction as the ends of the product being cross folded change directions and are subjected to this "whip effect". If this slow down and reversal of travel direction is not accomplished properly, it is possible for the products to either slip out of the gripper devices or for the products which are being held with increased clamping force, to be ripped off the retaining devices. In either instance, the result is a damaged or otherwise unacceptable printed and cross-folded product.

It will thus be seen that a need exists for a folding apparatus which will operate at high production speeds while not causing any damage to the cross-folded products. The folding apparatus for rotary printing presses in accordance with the present invention provides such a device and is a significant improvement over the prior art devices.

SUMMARY OF THE INVENTION

It is an object of the present invention to provide a folding apparatus for a rotary printing press.

Another object of the present invention is to provide a folding apparatus for a web fed rotary printing press.

A further object of the present invention is to provide a folding apparatus for a rotary printing press which is operable at high production speeds.

Still another object of the present invention is to provide a folding apparatus for a rotary printing press which does not damage the product in the course of making the first cross fold in the product.

Yet a further object of the present invention is to provide a folding apparatus having at least one single stage device for reducing the speed of the signatures and which is disposed between a collecting cylinder and a folding jaw cylinder.

As will be set forth in detail in the description of the preferred embodiments which are presented subsequently, the folding apparatus for a rotary printing press in accordance with the present invention utilizes a first cross-cutting device to divide a printed web into a stream of signatures which are fed to a collecting cylinder. The signatures may be collected or the collection cylinder may act merely as a transfer cylinder in uncollected production. Two product paths are provided downstream of the collection cylinder with each path including a transfer cylinder and a folding blade cylinder and folding jaw cylinder pair. The cross folded products from each folding jaw cylinder are delivered by a reversing roller to a paddle wheel and then to a cross fold delivery conveyor. A second transfer cylinder may be interposed between the first transfer cylinder and the folding blade cylinder. The speed of travel of the cross cut signatures is reduced between the collection cylinder and the delivery conveyor by using appropriate drive gear connections between the transfer cylinder or cylinders, the collection cylinder, the folding knife cylinder and the folding jaw cylinder. These gears are used to reduce the rotational speeds of the cylinders and hence to reduce the speed of the signatures so that the damage caused by the "whip effect" is overcome.

The splitting of the cross-cut products, which takes place in the production direction directly after the collection cylinder, into two product paths which each separately leads to a folding process, also has a speed reduction effect on the products. The inclusion of a single stage or of a double stage delay or speed reduction of the unfolded signatures in each path between the collection cylinder and the folding jaw cylinder also reduces the speed of travel. Accordingly, mass forces are also reduced so that the detrimental results of the "whip effect", which will typically appear at high speeds, are reduced. In addition, it is possible to use the folding apparatus in collected production of up to three collection in addition to use of the apparatus in uncollected or double production. It is further possible, in accordance with the present invention, to use only one of the two product paths which are leading away from the collection cylinder, particularly in the case of singly collected production.

A stapling cylinder can be utilized in conjunction with the collection cylinder. This allows each signature that is received by the collection cylinder to be stapled prior to being cross folded. The stapling can be accomplished in alignment with the first cross fold which will subsequently be accomplished. This stapling can take place particularly with magazines being produced by the rotogravure process.

The folding apparatus for rotary printing presses in accordance with the present invention allows the printed products, which have been produced at a high production speed, to be cross-folded without damage. It overcomes the limitations of the prior art devices and is a substantial advance in the art.

BRIEF DESCRIPTION OF THE DRAWINGS

While the novel features of the folding apparatus for rotary printing presses in accordance with the present invention are set forth with particularity in the appended claims, a full and complete understanding of the invention may be had by referring to the detailed description of the preferred embodiments which are presented subsequently, and as illustrated in the accompanying drawings, in which:

DESCRIPTION OF THE PREFERRED EMBODIMENTS

Figure 1:
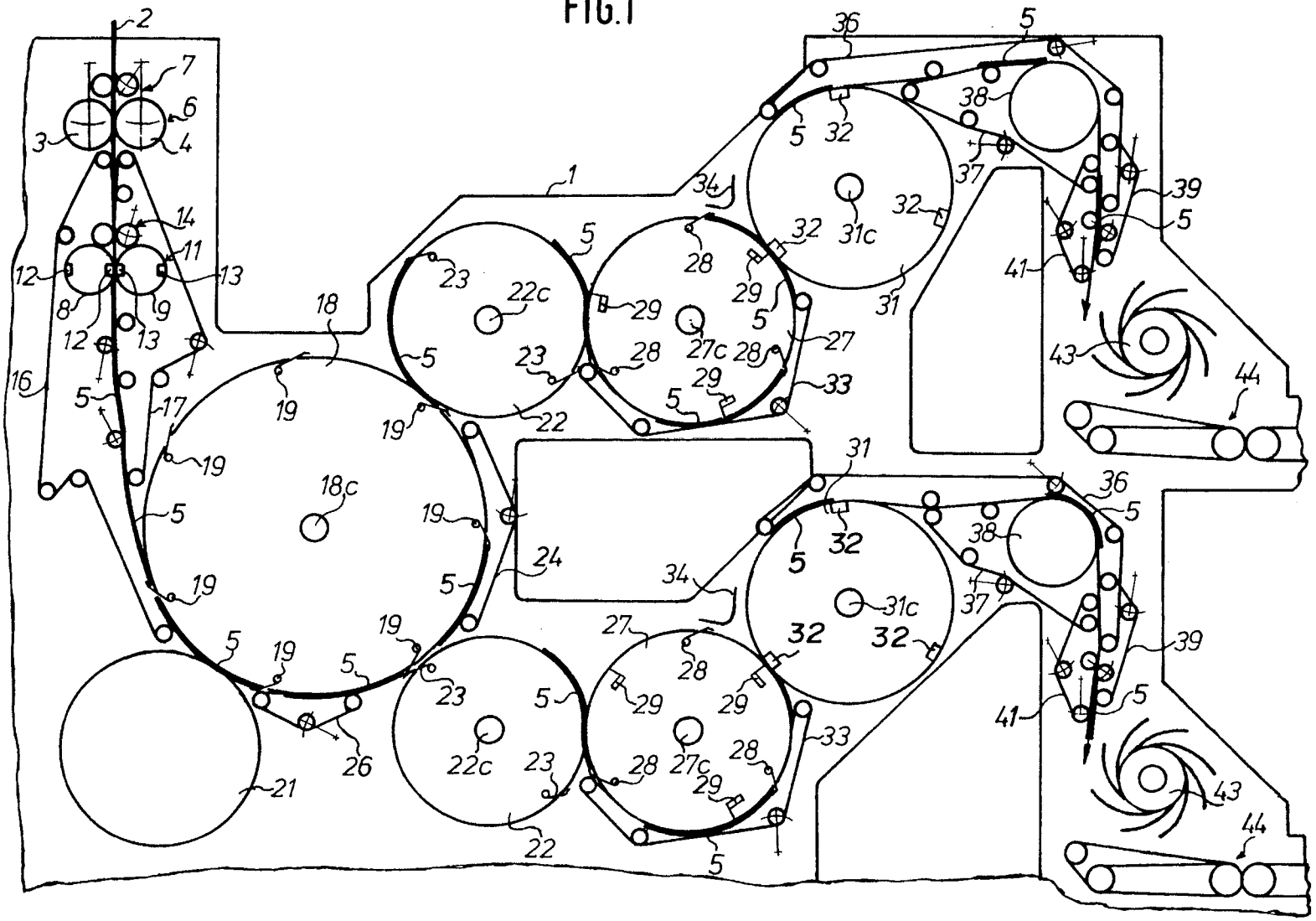
FIG. 1 is a schematic side elevation view of a first embodiment of a folding apparatus for a rotary printing press in accordance with the present invention.
Figure 2:
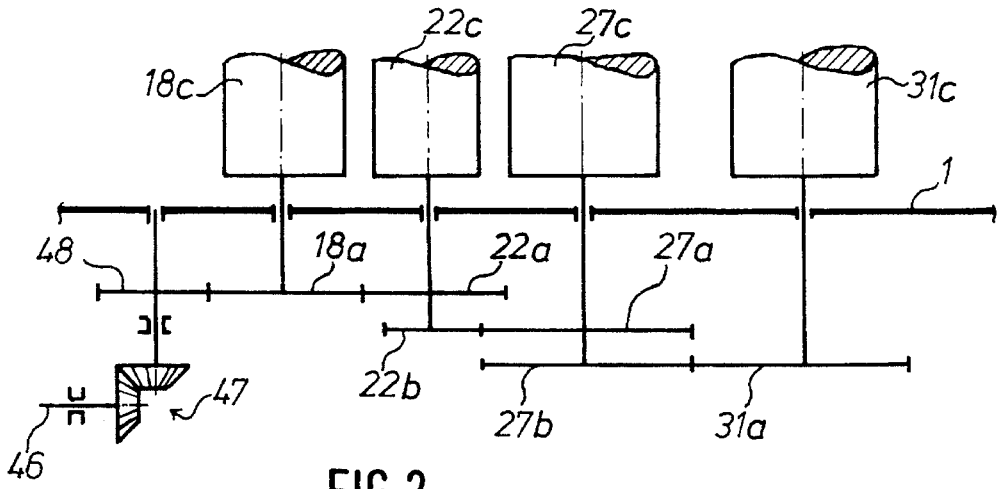
FIG. 2 is a schematic top plan view of a drive gear train for the folding apparatus of FIG. 1.

Referring initially to FIG. 1, and taken in conjunction with FIG. 2, there may be seen a first preferred embodiment of a folding apparatus for rotary printing presses in accordance with the present invention. The folding apparatus of the present invention has two side frames which are disposed parallel to each other, however, only one side frame 1 of the two is illustrated. A printed paper web 2, arriving from a web feeding device, not shown, passes through a first cross-cutting device 6 that is composed of cutter and groove cylinders 3 and 4, respectively for making a perforating cut in the paper web 2. A pair of pulling cylinders 7 are placed upstream of this first cross-cutting device 6. A second cross-cutting device 11, which consists of a cutter cylinder 8 and a groove cylinder 9, is also located in the area of the folding apparatus intake. The cutter cylinder 8 is provided with a cutter strip 12. The groove cylinder 9 has a groove strip 13 on its circumference. A pair of pulling cylinders 14 are associated with the second cross-cutting device 11. The second cross-cutting device 11 cuts the paper web 2, at locations where the web 2 has not yet cut by the first cross-cutting device 6, into a plurality of individual products, respectively indicated by 5. The second cross-cutting device 11 is enclosed within an acceleration track 16 and 17, which can consist of a driven belt guide system, and which accelerates and supplies the signatures 5 to a seven-fielded collection cylinder 18 which is equipped with seven generally conventional gripper systems 19 about its circumference. In place of the gripper systems 19, it is also possible to provide point spurs, if required. Directly adjacent the input of the signatures 5 into the collection cylinder 18 it is possible to dispose a known four-fielded stapling cylinder 21. If required, and by means of stapling heads, not shown, disposed on its circumference, the stapling cylinder 18 will insert staples in the alignment line of the cross fold still to be formed, and in the process cooperates with an abutment, not shown, on the jacket surface of the collection cylinder 18. A device of this type is described in German Patent 11 89 562.

Two similar four-fielded transfer cylinders 22, each with two known gripper systems 23, are located offset from each other on the circumference of the collection cylinder 18. Belt conveyor systems 24 and 26 are provided adjacent the circumference of the collection cylinder 18 between the stapling cylinder 21 and, looking in the direction of rotation of the collection cylinder 18, the first transfer cylinder 22, and between the first transfer cylinder 22 and, looking in the direction of rotation of the collection cylinder 18, the second transfer cylinder 22. The circumferential speeds of the collection cylinder 18 and the transfer cylinders 22 can be greater than 20 m/s. A six-fielded gripper and folding knife cylinder 27 that has three gripper systems 28, that are offset by 120° with respect to each other, and which are alternatingly disposed with three folding knife systems 29, is disposed downstream of each transfer cylinder 22. Each gripper and folding knife cylinder 27 cooperates with a six-fielded folding jaw cylinder 31, with three folding jaw systems 32, that is disposed downstream of the respective first and second paths of travel of the individually cut product 5 from the collect cylinder 9 to the transfer cylinders 22 and the gripper and folding blade cylinders 27 in the direction of the product path. Through the utilization of a gear drive arrangement to be described in detail later, the running speed of the signatures 5 is decreased by approximately 25% because of the transfer from the transfer cylinder 22 to the gripper and folding knife cylinder 27, so that the speed of the folded product, which is also identified by 5, is reduced by approximately one quarter and its mass forces by approximately one-half, when the "whip effect" occurs during the folding process between the gripper and folding knife cylinder 27 and the folding jaw cylinder 31.

A generally conventional belt guide system 33 is disposed in the direction of travel in each of the two product paths at the circumference of the gripper and folding knife cylinder 27 which is located between the transfer cylinder 22 and the folding jaw cylinder 31. A paper guide hoop 34 is provided, looking in the product path, after the point where the two cylinders 27 and 31 touch (together with the product 5) in order to also reduce the results of the "whip effect". The products 5, which have now been provided with a cross fold and are possibly stapled, are brought through a belt guide systems 36 and 37 and over a reversing roller 38 and then, with their running speeds reduced by approximately 55% by a deceleration system consisting of two belt guide systems 39 and 41, to a paddle wheel 43 which then transfers the products 5 to a cross fold delivery 44.

Turning now to FIG. 2 there is shown in somewhat schematic form, a top view of a drive wheel train for the cylinders 18, 22, 27 and 31 with there being depicted axle arms **18*c*, 22*c*, 27*c*, 31*c* of the cylinders 18, 22, 27, 31. A bevel gear 47, which is connected with the main press driveshaft 46 is frictionally and interlockingly connected with a drive gear wheel 48. The drive gear wheel 48 meshes with a gear wheel 18*a* of the collection cylinder 18. The collect cylinder gear wheel 18*a*, in turn, meshes with a transfer gear wheel 22*a* of the transfer cylinder 22, which is frictionally and interlockingly connected with a smaller transfer cylinder reduction gear wheel 22*b*. The transfer cylinder reduction gear wheel 22*b* meshes with a gripper cylinder gear wheel 27*a* of the gripper part of the gripper and folding knife cylinder 27, wherein the step-down between the gear wheels 22*b* and 27*a* is such that the circumferential speed between the cylinders 22 and 27 is reduced by approximately 25%. The gear wheel 27*a* is connected frictionally and interlockingly by means of a shaft with a gripper cylinder reduction gear wheel 27*b*. The gripper cylinder reduction gear wheel 27*b* meshes with a folding jaw cylinder drive gear wheel 31*a* of the folding jaw cylinder 31. The gear wheels mentioned above are frictionally and interlockingly secured to shafts which are supported in the side frame 1 by suitable bearings and shafts, not depicted in detail. With the cylinders 22 and 27 having approximately the same diameter and with a reduction in speed of the cylinder 27 with respect to the cylinder 22 because of the previously discussed step-down, it is possible to equip the slower moving six-fielded gripper and folding knife cylinder 27 with three gripper systems 28 in contrast to the four-fielded transfer cylinder 22 equipped with two gripper systems 23. The drive wheel train illustrated in FIG. 2 for use with the first product path is also used with the second product path that consists of duplicates of the devices 22, 27 and 31. The drives for the stapling cylinder 21 as well as for the devices downstream of the folding jaw cylinder 31 have not been taken into consideration for simplicity's sake. For folding control, the gripper and folding knife part of the gripper and folding knife cylinder 27 is connected with a wheel set and differential, not shown. The cylinders 22 and 27 act as single-stage devices for reducing the speed of signatures 5**.

Figure 3:
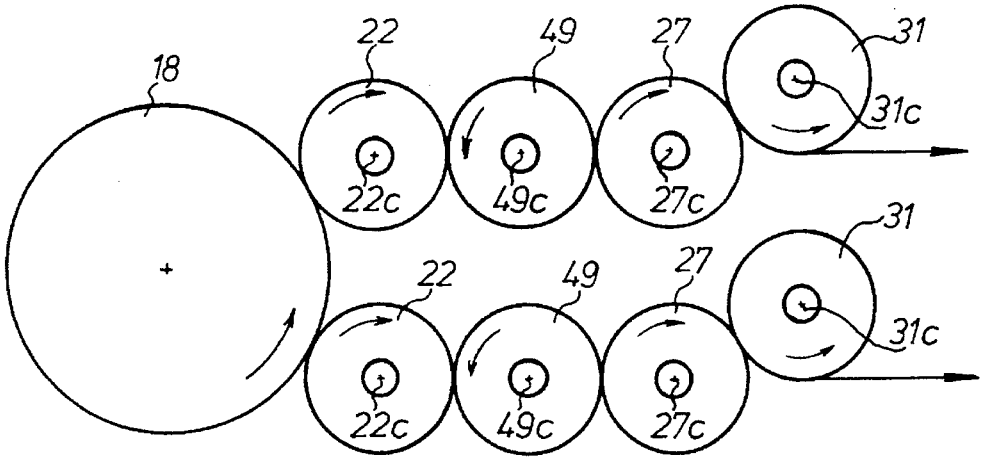
FIG. 3 is a simplified schematic side elevation view of a second preferred embodiment of a folding apparatus in accordance with the present invention.
Figure 4:
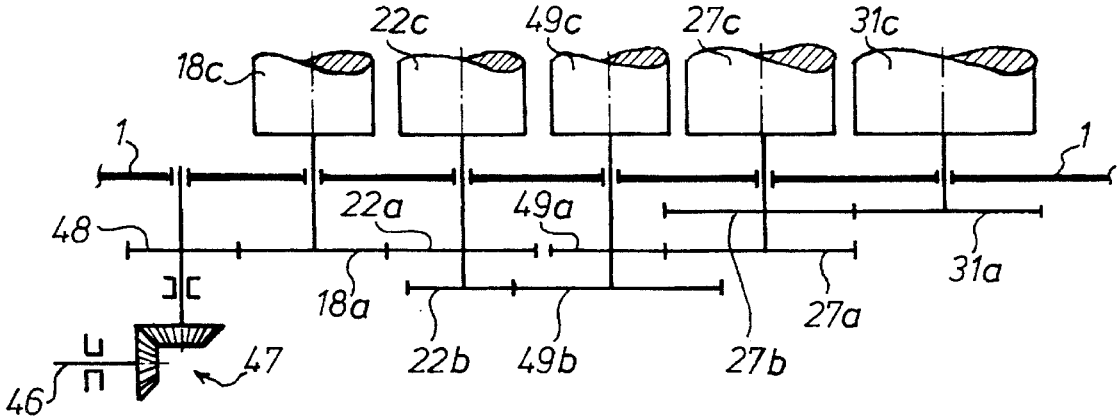
FIG. 4 is a schematic top plan view of a drive train for the folding apparatus of FIG. 3.

FIG. 3 shows a schematic side view, which is limited to only the cylinders, of a second preferred embodiment of a folding apparatus in accordance with the invention. The different of this second embodiment from the first embodiment as shown in FIG. 1 is that a second four-fielded transfer cylinder 49, which, in the same manner as the transfer cylinder 22, also has two gripper systems 23, is inserted between the four-fielded transfer cylinder 22 and the six-fielded gripper and folding knife cylinder 27. By means of a corresponding further step-down, as depicted in FIG. 4 between the first transfer cylinder reduction gear wheel **22*b* and the gripper cylinder drive gear 27*a* by interpositioning second transfer cylinder drive gear wheels 49*b* and 49*a*, which are frictionally and interlockingly connected with each other, it is possible to lower the circumferential speed between the transfer cylinder 22 and the folding jaw cylinder 31 in two stages by approximately 25%. Accordingly, this also applies to the reduction of the mass forces. In this second preferred embodiment the cylinders 18, 22, 49, 27, 31 have axle arms 18*c*, 22*c*, 49*c*, 27*c*, 31*c* which are depicted in FIG. 4**.

The two-stage device 22, 49, 27 for reducing the speed of signatures 5 respectively ahead of the folding jaw cylinder 31, as depicted in FIGS. 3 and 4, is of particular advantage with double production. With multiply- collected production, one of the first or second product paths can be turned off via a device 22, 27, 31, 38, 47, 48 by known means.

It is also possible to equip the second transfer cylinder 49 of FIG. 3 in a six-fielded manner with three gripper systems, and the gripper and folding knife cylinder 27 in a eight-fielded manner with four gripper systems and four folding knife systems which are offset by 90° with respect to each other and are alternatingly disposed. In this case the transfer cylinder 49 and the gripper and folding knife cylinder 27 respectively provide a reduction of the circumferential speed of approximately 25%.

While first and second preferred embodiments of a folding apparatus for rotary printing presses in accordance with the present invention have been set forth fully and completely hereinabove, it will be apparent to one of skill in the art that a number of changes in, for example, the specific drive gears, the operating elements for the gripper systems and folding blades and jaws, and the like could be made without departing from the true spirit and scope of the present invention which is accordingly to be limited only by the following claims.

What is claimed is:

1. A folding apparatus for rotary printing presses, said folding apparatus being operable to reduce the transportation speed of signatures being forwarded, said folding apparatus comprising:

a cross-cutting device for receiving a web traveling at a web production speed and for cutting a web into a plurality of signatures;

a collection cylinder rotating at a first constant circumferential speed for receipt of said signatures traveling from said cross-cutting device at said web production speed;

a first transfer cylinder in a first product path for said signatures, said first transfer cylinder operating at said first constant circumferential speed and receivinq said signatures from said collection cylinder;

a second transfer cylinder positioned downstream in said first product path from said first transfer cylinder and operating at a second constant circumferential speed which is less than said first constant circumferential speed, said second transfer cylinder receiving said signatures from said first transfer cylinder;

a first gripper and folding knife cylinder and a cooperating folding jaw cylinder in said first product path for creating folded products from said signatures, said first gripper and folding knife cylinder being positioned downstream in a direction of signature travel from said second transfer cylinder and operating at a third constant circumferential speed which is less than said second constant circumferential speed to reduce said traveling speed of said signatures received by said first gripper and folding knife cylinder from said second transfer cylinder to said third constant circumferential speed; and a first delivery device for receipt of said folded products from said folding jaw cylinder.

2. The folding apparatus of claim 1 wherein said first transfer cylinder has four fields and two diametrically opposed gripper systems on its circumference.

3. The folding apparatus of claim 1 wherein said first and second transfer cylinders each have four fields and two diametrically opposed gripper systems on their peripheries.

4. The folding apparatus of claim 1 wherein said collection cylinder has seven gripper systems on its periphery.

5. The folding apparatus of claim 1 wherein said folding jaw cylinder has six fields and three folding jaw systems on its circumference.

6. The folding apparatus of claim 1 wherein said folding knife cylinder has six fields with three gripper systems and three folding knife systems alternatingly disposed at 120° with respect to each other on a circumferential surface of said folding knife cylinder.

7. The folding apparatus of claim 1 further including a second folding knife cylinder and cooperating second folding jaw cylinder in a second product path; a second delivery device for receipt of said folded products in said second product path and a third transfer cylinder in said second product path, said third transfer cylinder being upstream of said second folding knife cylinder.

* * * * *